US012508488B2

(12) United States Patent
Hubbell et al.

(10) Patent No.: US 12,508,488 B2
(45) Date of Patent: Dec. 30, 2025

(54) APPARATUS FOR MEASURING PROPERTIES OF GOLF PUTTING SURFACE

(71) Applicant: United States Golf Association, Liberty Corner, NJ (US)

(72) Inventors: James E. Hubbell, Whitehouse Station, NJ (US); Scott A. Mingay, Madison, NJ (US); Matthew M. Pringle, Bordentown, NJ (US); Stephen U. States, Hillsborough, NJ (US)

(73) Assignee: United States Golf Association, Liberty Corner, NJ (US)

( * ) Notice: Subject to any disclaimer, the term of this patent is extended or adjusted under 35 U.S.C. 154(b) by 910 days.

(21) Appl. No.: 17/737,632

(22) Filed: May 5, 2022

(65) Prior Publication Data

US 2022/0355177 A1 Nov. 10, 2022

Related U.S. Application Data

(60) Provisional application No. 63/184,390, filed on May 5, 2021.

(51) Int. Cl.
*A63B 69/36* (2006.01)

(52) U.S. Cl.
CPC ..... *A63B 69/3688* (2013.01); *A63B 2220/40* (2013.01); *A63B 2220/78* (2013.01); *A63B 2225/50* (2013.01)

(58) Field of Classification Search
CPC ..... A63B 69/3688; A63B 2220/40; A63B 2220/78; A63B 2225/50; A63B 37/0003; A63B 2220/833; A63B 43/004; A63B 43/06; A63B 71/0622; A63B 2102/32; A63B 2220/53; A63B 2225/02; A63B 69/36; A63B 69/3676
See application file for complete search history.

(56) References Cited

U.S. PATENT DOCUMENTS

| | | | | |
|---|---|---|---|---|
| 4,006,626 | A * | 2/1977 | Ruzicka | G01N 3/52 73/12.02 |
| 2009/0280920 | A1 | 11/2009 | Rankin | |
| 2011/0160003 | A1 | 6/2011 | Pelz | |
| 2016/0367861 | A1* | 12/2016 | Pelz | A63B 71/06 |
| 2021/0113892 | A1* | 4/2021 | Eberle | A63B 37/0054 |

OTHER PUBLICATIONS

Written Opinion of the International Searching Authority in PCT/US2022/027859 (Sep. 23, 2022).
International Search Report in PCT/US2022/027859 (Sep. 23, 2022).

* cited by examiner

*Primary Examiner* — Jeffrey S Vanderveen
(74) *Attorney, Agent, or Firm* — Pryor Cashman LLP

(57) ABSTRACT

A method for measuring physical properties, e.g., firmness, smoothness, trueness, green speed, of a playing surface on a golf course, includes performing measurements via a measurement apparatus. The measurement apparatus includes a spherical sensor, which in turn includes an accelerometer for measuring motion data relating to motion of the spherical sensor, a memory for storing the motion data, and a communication module for wirelessly transmitting the motion data to a computing device.

14 Claims, 7 Drawing Sheets

APPARATUS FOR MEASURING PROPERTIES OF GOLF PUTTING SURFACE

CROSS-REFERENCE TO RELATED APPLICATIONS

The present application claims priority to U.S. Provisional Patent Application No. 63/184,390, filed on May 5, 2021, the disclosures and teachings of which are incorporated herein by reference.

TECHNICAL FIELD

The present application relates to an apparatus for measuring properties of a playing surface or putting surface such as a putting green or fairway, and in particular an apparatus that is capable of measuring the firmness, smoothness, trueness, and green speed of the playing surface or putting surface.

BACKGROUND

It is important to maintain the consistency of the conditions of various properties of golf courses, to allow golfers to make predictable shots based upon their skill levels instead of making shots that cause the golf ball to react randomly due to inconsistent conditions of the golf course. As such, the properties of a golf course, which include firmness (how hard the surface is), smoothness (how bumpy the surface is, namely by vertical movement), trueness (how much the golf ball moves side to side, i.e., horizontally), and green speed (how fast the golf ball moves across the surface). The ideal firmness for a putting surface is firmness that is receptive to a well-struck approach shot. The ball should impact the surface, bounce forward, hold, and then release. The putting surface should recover after impact with minimal pitch marking. The ideal smoothness is one in which the golf ball does not bounce or move upwards with respect to the surface, but rather maintains a consistent motion as it moves. The ideal trueness is where the golf ball moves in a perfectly straight line without moving from side to side. The ideal green speed is one in which the speed of the golf ball matches the topography, e.g., firmness, smoothness, trueness, and skill level of the golfer to provide an adequate challenge.

Golf course conditions, however, can change daily or often. As such, it is important to maintain golf courses to have close to ideal conditions with respect to firmness, smoothness, trueness, and green speed. It is often difficult to measure these properties (firmness, smoothness, trueness, and green speed) due to the fact that conventional means of measurements require large numbers of people and equipment to obtain an accurate measurement of the conditions and properties of a golf course.

SUMMARY

In general, in one aspect, exemplary embodiments of the present application provide a measurement apparatus for measuring physical properties of a playing surface of a golf course, the measurement apparatus including a spherical sensor comprising an accelerometer for measuring motion data relating to motion of the spherical sensor, a memory for storing the motion data, and a communication module for wirelessly transmitting the motion data to a computing device, a substantially cylindrical body having a first and a second end, the first end configured to receive the spherical sensor, and a cap shaped to receive the spherical sensor and configured to removably attach to the first end of the cylindrical body.

Implementations of the various exemplary embodiment of the present application may include one or more of the following features. Each of the cylindrical body and the cap has a hemi-spherical shape for receiving the spherical sensor. The accelerometer measures acceleration of the spherical sensor. The measurement apparatus further includes a gyroscope for determining an orientation of the spherical sensor. The spherical sensor communicates the motion data to the computing device after the spherical sensor ceases movement. The cap includes a mass greater than a mass of each of the spherical sensor and the cylindrical body. The cap includes a female threaded surface and the cylindrical body includes a male threaded surface, such that the cap is removably attached to the cylindrical body by mating of the female threaded surface with the male threaded surface. The measurement apparatus measures firmness of the playing surface. The firmness of the putting surface is measured by dropping the spherical sensor disposed in the cylindrical body and the cap onto the putting surface from a predetermined height. The spherical sensor is dropped using a dropping device. The spherical sensor, when disassembled from the cylindrical body and the cap, measures smoothness or trueness of the playing surface.

In general, in one aspect, exemplary embodiments of the present application provide a method for measuring physical properties of a playing surface of a golf course, the method including measuring firmness of the playing surface with a spherical sensor disposed in a cylindrical body and a cap, the spherical sensor including an accelerometer for measuring motion data relating to motion of the spherical sensor, a memory for storing the motion data, and a communication module for wirelessly transmitting the motion data to a computing device, and measuring smoothness or trueness of the playing surface with the spherical sensor disassembled from the spherical body and the cap. Implementations of the various exemplary embodiment of the present application may include one or more of the following features. The step of measuring firmness of the playing surface further includes dropping the spherical sensor disposed in the cylindrical body and the cap onto the playing surface. The dropping step is performed using a dropping device. The step of measuring smoothness or trueness of the playing surface further includes disassembling the spherical sensor from the cylindrical body and the cap, and rolling the spherical sensor on the playing surface. In general, in one aspect, exemplary embodiments of the present application provide a method for measuring physical properties of a playing surface of a golf course, the method including measuring firmness of the playing surface with a spherical sensor comprising an accelerometer for measuring motion data relating to motion of the spherical sensor, a memory for storing the motion data, and a communication module for wirelessly transmitting the motion data to a computing device, and measuring smoothness or trueness of the playing surface with the spherical sensor. Implementations of the various exemplary embodiment of the present application may include one or more of the following features. The step of measuring firmness of the playing surface further includes dropping the spherical sensor onto the putting surface. The dropping step is performed using a dropping device. The step of measuring smoothness or trueness of the playing surface further includes rolling the spherical sensor on the playing surface.

BRIEF DESCRIPTION OF DRAWINGS

The aforementioned and other aspects, features and advantages can be more readily understood from the following detailed description with reference to the accompanying drawings, wherein.

DETAILED DESCRIPTION

Figure 1:
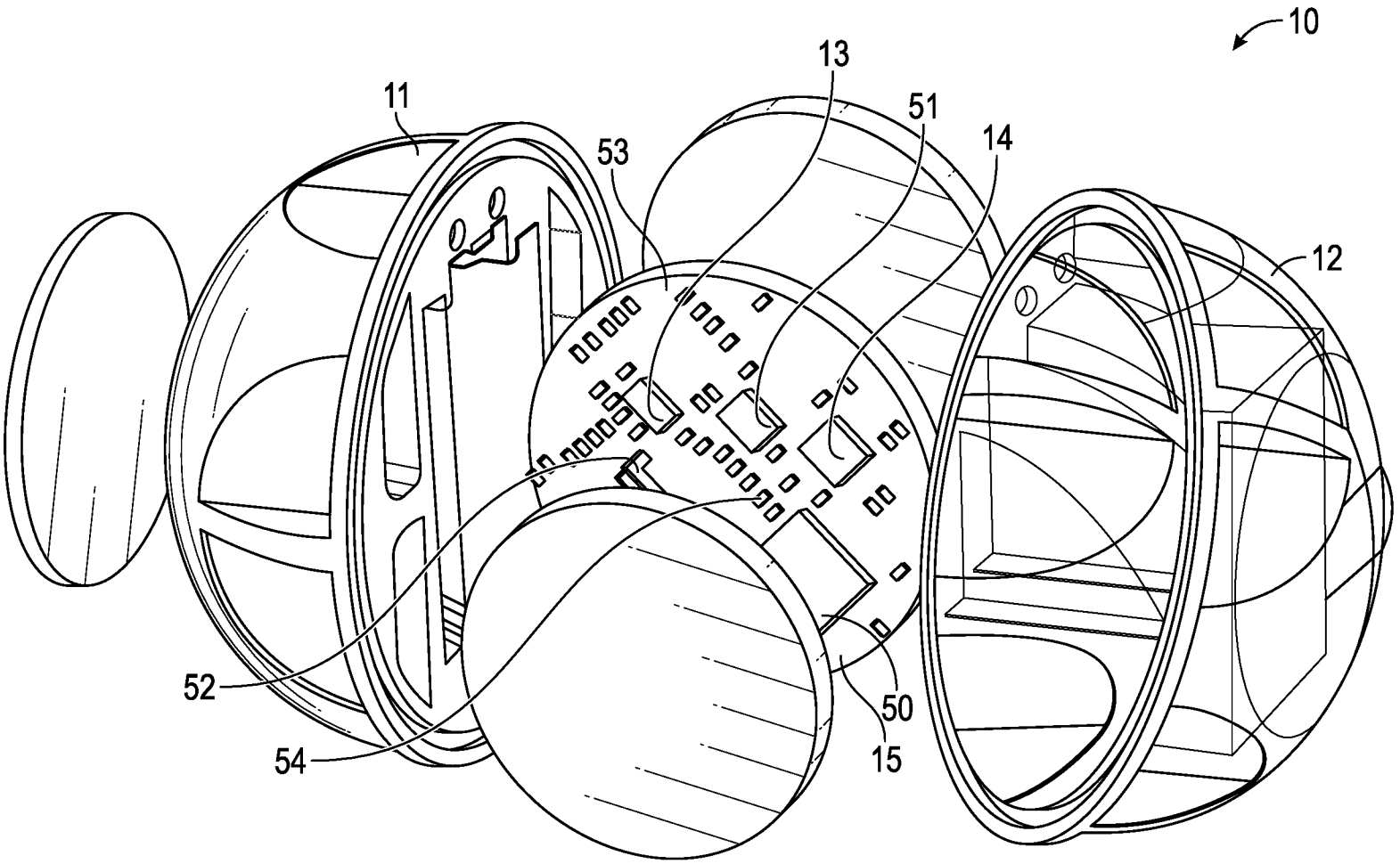
FIG. 1 shows an exploded view of a spherical sensor according to an embodiment of the present invention.

In describing preferred embodiments illustrated in the drawings, specific terminology is employed herein for the sake of clarity. This disclosure, however, is not intended to be limited to the specific terminology so selected and it is to be understood that each specific element includes all technical equivalents that operate in a similar manner. In addition, a detailed description of known functions and configurations is omitted from this specification when it may obscure the inventive aspects described herein.

Referring to FIG. 1, the spherical sensor includes a body 10 having a first portion 11, a second portion 12, a first accelerometer 13, a second sensing device 14, and a circuit board 15. In one exemplary embodiment, the body 10 may be made of a plastic material. In another exemplary embodiment, the body 10 may have a mass of about 46 grams and/or a diameter of about 1.68 inches. In yet another exemplary embodiment, the body 10 may receive power via wireless charging, e.g., an inductive charging system. It should also be noted that, during manufacturing of the spherical sensor 10, a polymer cover may be molded over the spherical sensor to be waterproof or water resistant.

The body 10 may also include status indicator lights (not shown), which may provide an indication of charging status and/or wireless communication connectivity. In another example, the body 10 may turn off or stop operating after a predetermined period of time in which the body 10 remains motionless. In yet another example, a user may tap or touch the body 10 a predetermined number of times, e.g., twice, to place the body 10 in an operational mode (on) or a non-operational mode (off).

The body 10 preferably has an outer spherical shape, such that each of the first portion 11 and the second portion 12 has a hollow hemi-spherical shape. In one exemplary embodiment, each of the first portion 11 and the second portion 12 has a smooth outer surface to be able to measure accurately the smoothness or other physical properties of a playing surface or a putting surface. For example, the playing surface or putting surface may refer to any grounds within a golf course such as, but not limited to, fairways, putting greens, bunkers, penalty areas, roughs and/or out of bound areas. It should also be noted that the terms playing surface and putting surface can be used interchangeably in the present application, and that the playing surface and the putting surface are not limited to the grounds of a golf course, but may be representative of grounds of other sports, such as, but not limited to, cricket. In another exemplary embodiment, the first portion 11 and the second portion 12 may be permanently secured to each other by a snapping mechanism.

The circuit board 15 may include a processor 50, a memory 51, a battery (rechargeable or non-rechargeable) 52, a charging circuit 53, and a wireless communication module 54, e.g., Wi-Fi, RFID, magnetic resonance and/or Bluetooth. The circuit board 15 may be mounted in the body 10, such that a center of gravity of the circuit board 15 lies within the spherical body 10, thereby causing, for example, the body 10 to roll in a smooth and uniform manner. In addition, the first accelerometer 13 and the second sensing device 14 may be mounted on the circuit board 15. For example, the first accelerometer 13 may be a multiple-axis, e.g., 3-axis, accelerometer capable of generating data relating to the motion of the spherical sensor and storing the data in the memory. In another example, the second sensing device 14 may be an accelerometer or a gyroscope capable of generating data relating to the motion of the spherical sensor and storing the data in the memory 51. In yet another example, the spherical sensor 10 may include a third sensing device or sensor 13*a* (not shown) and a fourth sensing device or sensor 13*b* (not shown). The third sensor 13*a* may be a multiple-axis accelerometer that measures high acceleration and the fourth sensor 13*b* may be a high-sensitivity multiple-axis accelerometer that measures low acceleration. It should be noted that the measurement axes of the first sensor 13 (accelerometer) and the second sensor 14 (gyroscope) may be orthogonal and/or aligned to each other.

The first accelerometer 13 and the second sensing device 14 generate motion data, which may be temporarily or permanently stored in the memory 51 of the circuit board 15. The processor 50 is programmed to control the operation of the first accelerometer 13, the second sensing device 14, the memory 51, and the wireless communication module 54. The battery 52 may be wirelessly charged from an external source via the charging circuit 52. The battery 52 provides power for the internal operation of the components of the spherical sensor 10, including the first accelerometer 13, the second sensing device 14, the processor 50, the memory 51, and the wireless communication module 54.

The wireless communication module 54 is capable of wireless communications with an external computing device (not shown). The computing device receives the data relating to the motion of the spherical sensor 10 stored in the memory 51 and performs calculations pertaining to physical properties of the putting surface for communication and/or display to the user. The computing device may include, but is not limited, to a desktop, tablet or notebook computer, a PDA (personal digital assistant), a mobile phone or hand-set, or another mobile information terminal that can communicate, e.g., wirelessly, with other devices directly and/or through a network. The computing device may include operating systems such as Microsoft Windows, Android, iOS and/or any other Unix or Linux-derived operating system. The user may send a test command from the computing device to the spherical sensor 10 to determine whether the spherical sensor 10 is operating or functioning correctly.

Figure 3:
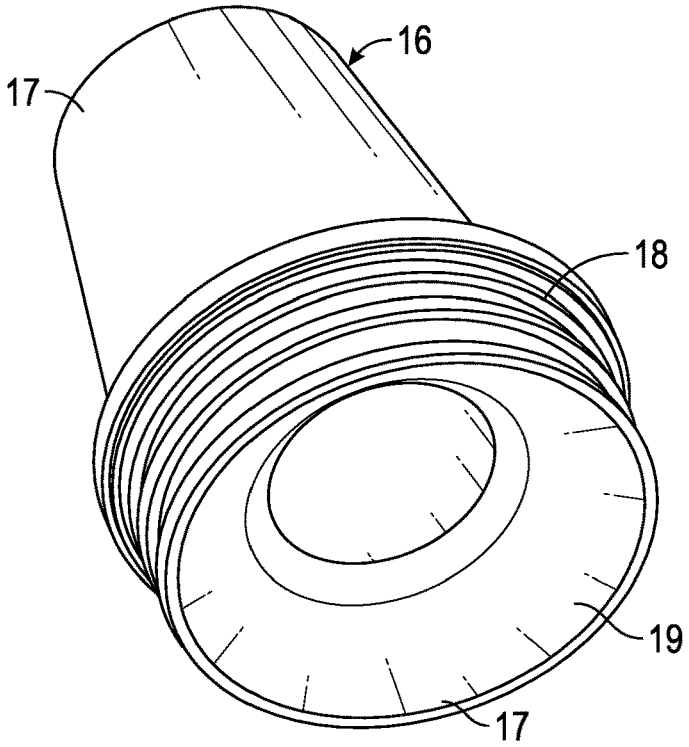
FIG. 3 shows a cylindrical body of the measuring assembly, when the measuring assembly is disassembled, according to an embodiment of the present invention.
Figure 4:
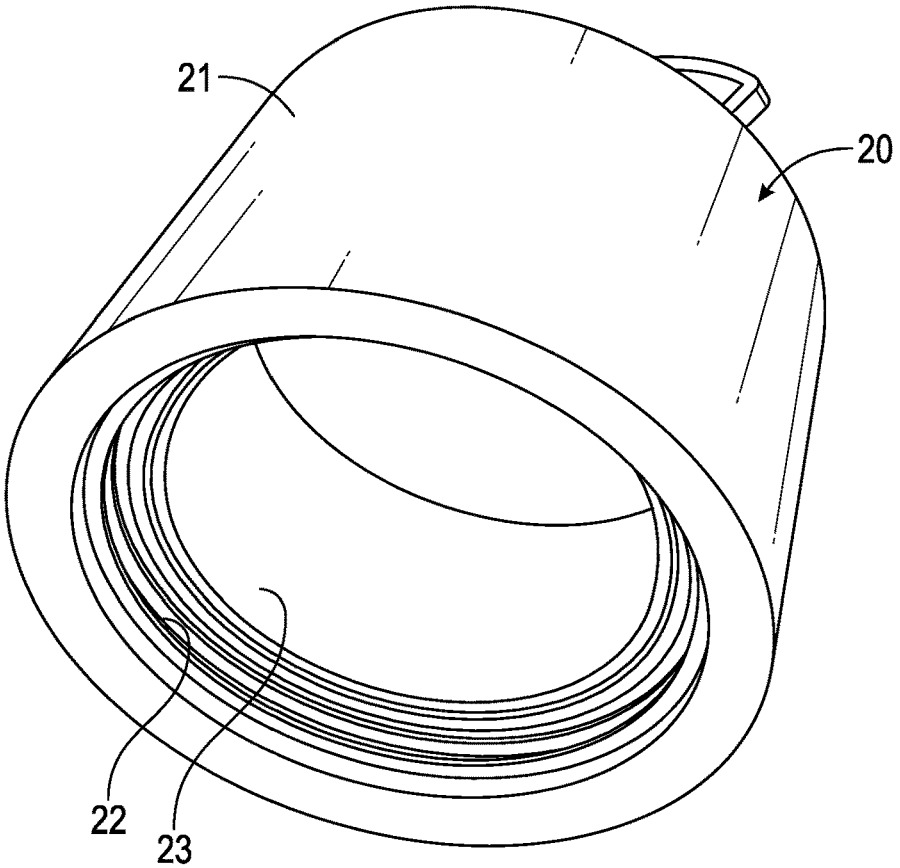
FIG. 4 shows a cap of the measuring assembly, when the measuring assembly is disassembled, according to an embodiment of the present invention.
Figure 5:
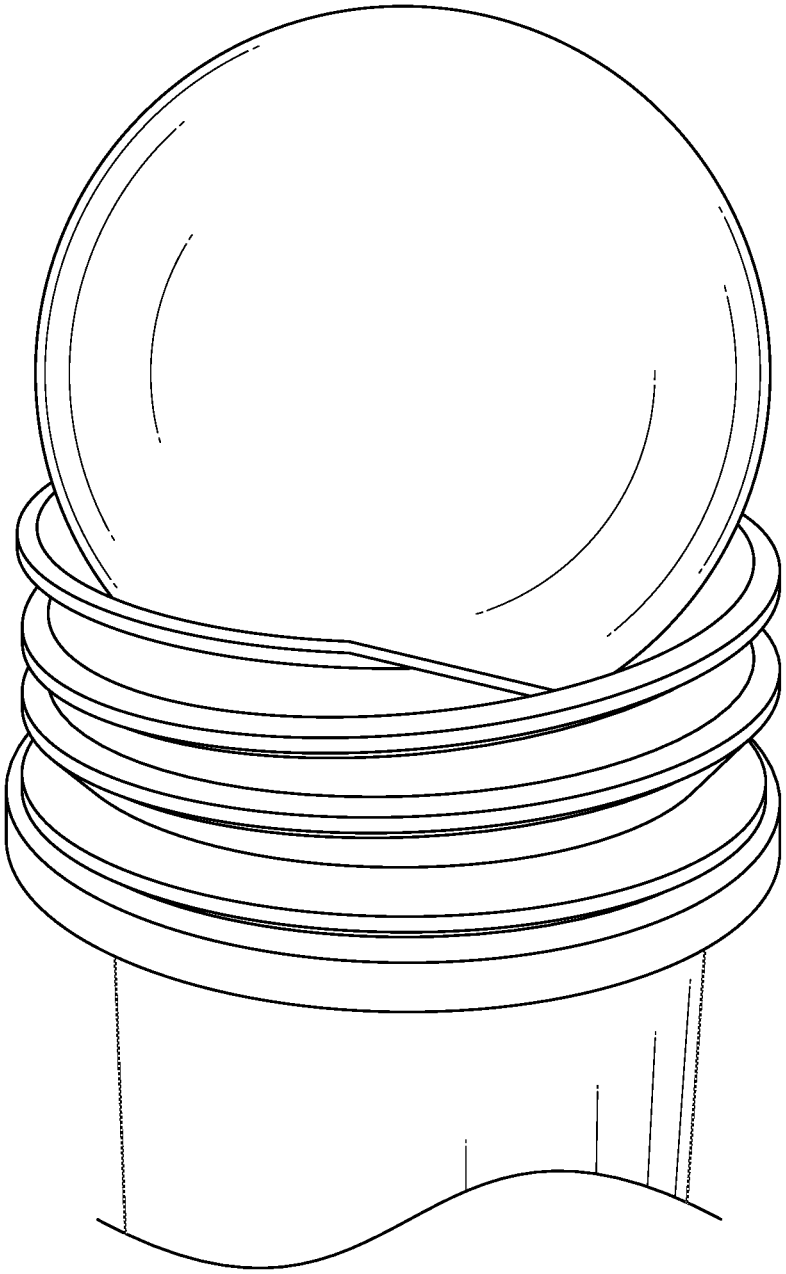
FIG. 5 shows the spherical sensor disposed on the cylindrical body according to an embodiment of the present invention.

Referring to FIGS. 3-5, the assembled spherical sensor 10 may be disposed upon and/or rest partially within one end of a cylindrical body 16 and may be removably secured thereto by a cap 20, the cylindrical body 16 and the cap 20 forming a measuring assembly 24. In one exemplary embodiment, the measuring assembly 24 is capable of being handled manually by a user. Referring to FIG. 3, the cylindrical body 16 may include a substantially cylindrical body portion 17, a threaded member 18, and an indented face 19. The cylindrical body portion 17 may include a smooth exterior surface for receiving the spherical sensor 10. The diameter of the cylindrical body portion 17 may be, for example, approximately equal to that of a golf ball, i.e., 1.68 inches. The threaded member 18 may be a male thread. The face 19 may include a depression that is configured to receive the spherical sensor 10, such that the spherical sensor 10 is held against the face 19, as shown in FIG. 5.

Figure 2:
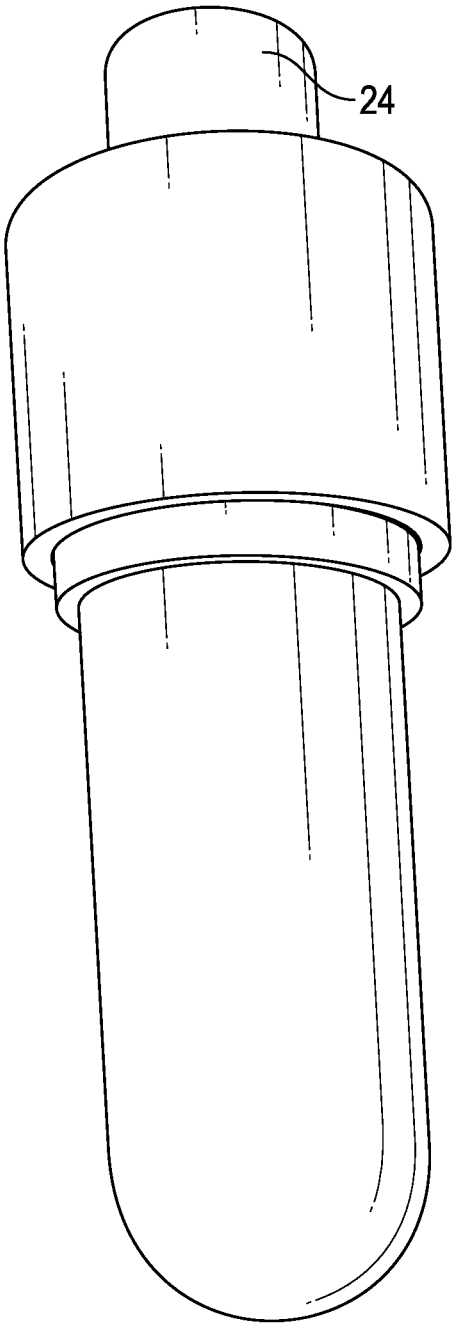
FIG. 2 shows a measuring assembly according to an embodiment of the present invention.

Referring to FIGS. 2 and 4, the cap 20 is configured to be removably secured to the cylindrical body 16, such that the spherical sensor 10 is secured in place by both the cap 20 and the cylindrical body 16. In one exemplary embodiment, the cap 20 may be formed as a single element. The cap 20 includes an enclosed first end and an open second end to form a cavity therein. A weight may be included in the cavity of the cap 20. The cap 20 also comprises a wall 21, which may be cylindrical, and includes a threaded section 22. The threaded section 22 may be disposed near the second end of the cap 20. In addition, an internal surface of the closed first end may be hemi-spherical, such that a portion of the spherical sensor 10 is capable of fitting within the hemi-spherical surface of the closed first end of the cap 20. As such, to assemble the measuring assembly 24, the spherical sensor 10 is first placed on the depression on the face 19 of the cylindrical body 16, as shown in FIG. 5. Next, the cap 20 is placed over the spherical sensor 10 and moves towards the cylindrical body 16 until the female threaded section 22 of the cap 20 makes contact with the male threaded member 18. Thereafter, the cap 20 is twisted or turned so that the male threaded member 18 and the female threaded section 22 is tightly secured to each other. It should be noted that the assembled measuring assembly 24 may have a mass between 100 and 5,000 grams, preferably 950 grams. In an exemplary embodiment, instead of threading, the cap 20 may be removably attached to the cylindrical body 16 via clips and/or a binding mechanism similar to that found in ski bindings, i.e., the mechanism that connects a ski boot to a ski.

To measure the firmness of the putting surface, the spherical sensor 10 is first secured to the cylindrical body 16 with the cap 20, thereby forming the measuring assembly 24. Next, the measuring assembly 24 is dropped vertically from a suitable, pre-determined height onto the putting surface. The suitable height may be representative of the momentum and energy of a golf ball striking and/or falling upon the putting surface. For example, the suitable height may be between 150 mm and 2,000 mm, preferably 406 mm.

In an exemplary embodiment, it is not necessary to secure the spherical sensor 10 to the cylindrical body 16 and cap 20 to form the assembly 24, to be able to measure the firmness of the putting surface by dropping the assembly 24 onto the putting surface from a predetermined height. Instead, the spherical sensor 10 (without the cylindrical body 16 and the cap 20) may be dropped by itself onto the putting surface from the predetermined height. The sensors, e.g., accelerometer 13, in the spherical sensor 10 may capture motion data from the drop. In yet another exemplary embodiment, a spherical sensor that is separate from the spherical sensor 10 may be utilized instead to measure the firmness of the putting surface.

The separate spherical sensor may also have a spherical shape, but may have different physical properties from the spherical sensor 10, such as a different mass or weight (heavier or lighter) that may be configured to obtain the most accurate firmness measurement. Like the spherical sensor 10, it is not necessary to have the separate spherical sensor combined with the cylindrical body 16 and cap 20 to form another assembly 24, to measure firmness.

Instead, the spherical sensor 10*b* can be dropped into the putting surface by itself. The separate spherical sensor may include sensors similar to the spherical sensor 10, e.g., accelerometer 13, that capture motion data from the drop.

In another exemplary embodiment, the cap 20 may have a mass or weight that is greater than that of the cylindrical body 16 and/or the spherical sensor 10, such that when the measuring assembly 24 is dropped, from any orientation, the weight of the cap 20 causes the cap 20 to impact the ground first before the cylindrical body 16 makes contact with the ground or causes the measuring assembly 24 to hit the ground with the cap 20 headfirst. In addition, the measuring assembly 24 may be released via a dropping device 25 configured to release the measuring assembly 24 in a manner that ensures consistent drop height free from any initial acceleration or rotation.

Figure 6:
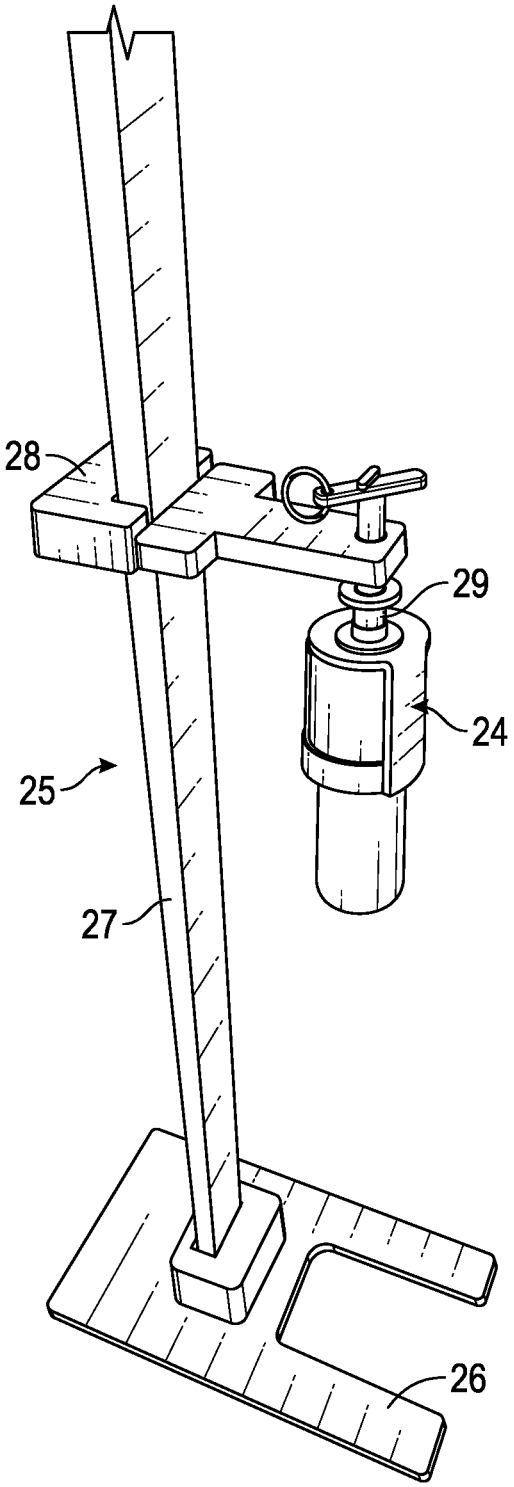
FIG. 6 shows a dropping device having the measuring assembly connected thereto according to an embodiment of the present invention.

An example of the dropping device 25 is shown in FIG. 6. The dropping device 25 includes a base 26, a shaft 27, a guide 28 and a handle 29. The base 26 is disposed on the ground and may include an opening that exposes the ground, e.g., the base 26 is U-shaped. The shaft 27 may be connected or mounted to the base 26, such that the shaft 27 is disposed in a direction that is perpendicular to the ground and base 26. The guide 30 may include an aperture (not shown) on a first end of the guide 30 that allows the guide 30 to be movably or fixedly mounted on the shaft 27. Further, the guide 30 extends away from the shaft 27 in a perpendicular direction, such that a second end of the guide 30 is aligned with the opening in the base 26. In addition, the second end of the guide 30 is connected to the handle 29. The measuring assembly 24 may be removably attached to the handle 29, such that the handle 29 may be in an unreleased position, which secures the assembly 24 to the handle 29, and a released position, which frees the handle 29 from the measuring assembly 24.

To utilize the dropping device 25, the user attaches the measuring assembly 24 to the handle 29, such that the handle 29 is in the unreleased position. The user then moves the handle 29 to the released position, which in turn drops the measuring assembly 29 to the putting surface. For example, the location at which the measuring assembly 29 makes contact with the putting surface may be the exposed ground corresponding to the opening of the base 26. The impact of the measuring assembly 24 upon the ground is measured using an accelerometer in the spherical sensor 10, e.g., accelerometer 13 or sensors 14, 13*a* and/or 13*b*. After the measuring assembly 24 is dropped either by hand or via the dropping device 25, the spherical sensor 10 communicates motion data obtained from at least one of the accelerometer 13 or sensors 14, 13*a*, and/or 13*b* to the computing device. In an exemplary embodiment, the user may initiate a process in which the spherical sensor 10 of the measuring assembly 24 perceives its state as stationary or motionless corresponding to being attached to the handle 29. After the measuring assembly 24 is dropped, the spherical sensor 10 detects movement via the accelerometer 13 or sensors 14, 13*a* and/or 13*b*. The spherical sensor 10 is then configured to recognize that the next time that the assembly 24 is motionless after its initial movement, the spherical sensor 10 has impacted the ground and, therefore, should communicate the motion data to the computing device immediately thereafter for processing.

After the computing device receives the motion data, the computing device may use the accelerometer information from the motion data to accurately determine the penetration depth of the measuring assembly 24. The computing device, for example, may first perform an integration process, in which the vertical component (z-axis) of the accelerometer information, i.e., $a_z(t)$, is integrated to obtain the velocity (V) of the measuring assembly 24:

$$V = \int \frac{d}{dt} a_z(t) + V_0$$

where $V_0$ is the initial velocity of the measuring assembly 24 immediately prior to impact. $V_0$ may be estimated based on the freefall height or may be computed with the accelerometer information between release and impact. The depth (D) that the measuring assembly 24 penetrates the ground may be determined by integrating the velocity over time, i.e., V(t):

$$D = \int \frac{d}{dt} V(t)$$

The penetration depth measures the firmness of the putting surface, with the firmness being inversely related to penetration depth; that is, the firmer the surface, the lower the penetration depth. Possible values for putting surface penetration depths range from 2.5 mm to 25 mm. For example, when an assembly 24 having a mass of 950 grams is released from a height of 406 mm, the impact momentum is approximately 1.15 kgm/s and the energy is approximately 3.78 J.

The spherical sensor 10, by itself, may also be used to measure the smoothness and/or trueness of the putting surface. First, the user may utilize the computing device to communicate with the spherical sensor 10 to commence the measurement of the smoothness and/or trueness of the putting surface. Next, the user may cause the spherical sensor 10 to move across the putting surface. For example, the user may manually roll the spherical sensor 10 or may use an inclined plane, e.g., Stimpmeter® instrument or Perfect Putter® instrument. The accelerometer 13 or sensors 14, 13*a* and/or 13*b* register the acceleration of the spherical sensor 10 and/or the angular velocity of the spherical sensor 10 from the start of the roll until the end of the roll, i.e., when the spherical sensor 10 comes to rest. In one exemplary embodiment, the computing device activates the accelerometer 13 or sensors 14, 13*a*, and/or 13*b* a moment, e.g., a few seconds, prior to rolling the spherical sensor 10 to reduce power consumption.

Figure 8:
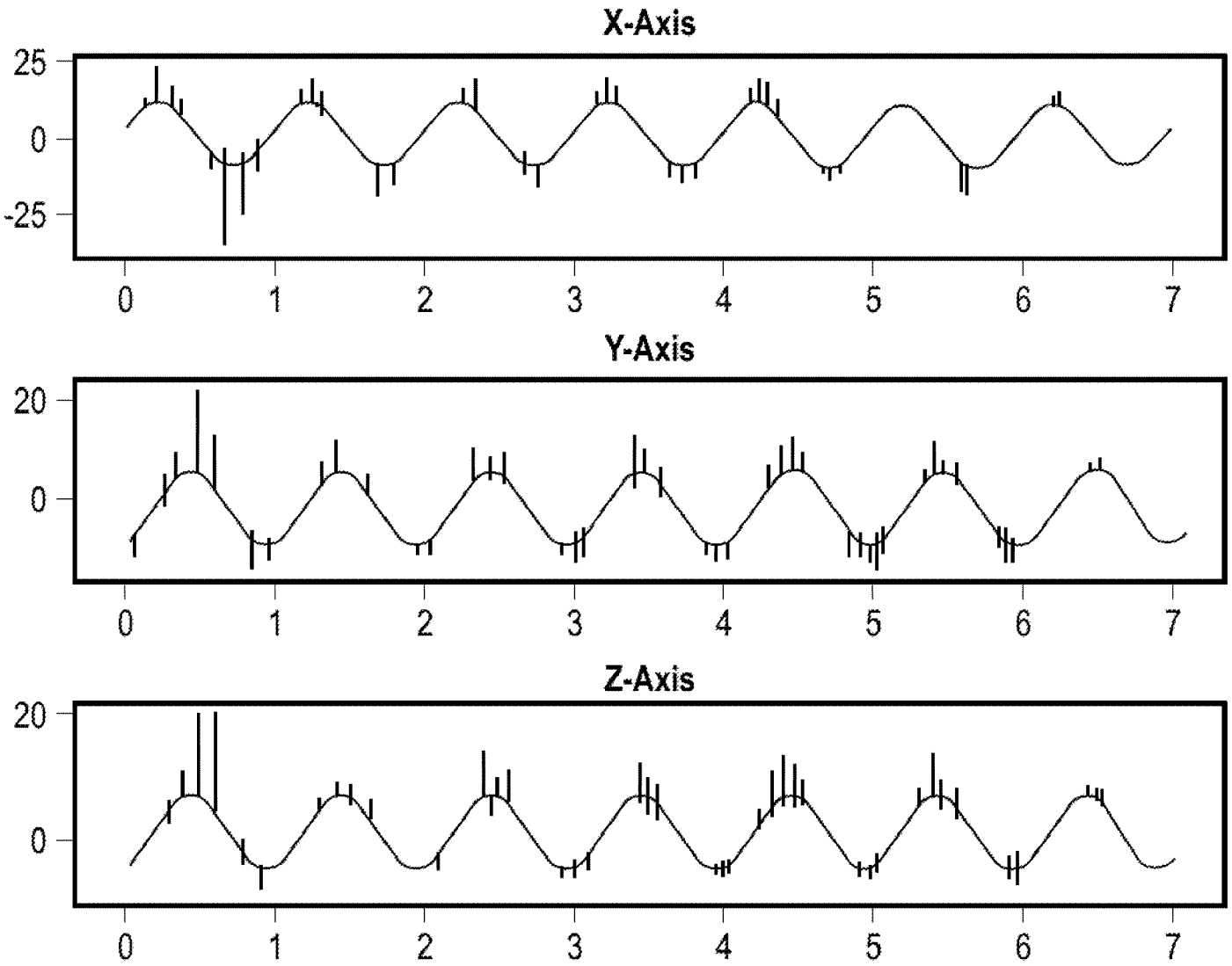
FIG. 8 shows a graph representing acceleration vs. time in connection with the different axes of the spherical sensor as the spherical sensor moves across the putting surface according to an embodiment of the present invention.

After the spherical sensor 10 stops rolling, the spherical sensor 10 communicates, e.g., wirelessly, the motion data collected by the accelerometer 13 or sensors 14, 13*a*, and/or 13*b* to the computing device. The motion data may include accelerometer information that is visually presented to the user via the computing device, such as shown in FIG. 8, in which the accelerometer information may be plotted as a sinusoidal wave on a graph having time as the independent axis and acceleration as the dependent axis. FIG. 8 displays three graphs each representing a different axes of the spherical sensor 10, i.e., x-axis, y-axis and z-axis, as it rolls across the putting green.

For example, when the spherical sensor 10 moves across the putting surface, the movement is represented along one axes, e.g., the y-axis. However, the properties of the putting surface may cause the spherical sensor 10 to move somewhat erratically from side to side (horizontally) in a direction perpendicular to the y-axis; such perpendicular movement is represented by the x-axis. In addition, the properties of the putting surface may also cause the spherical sensor 10 to bounce up or down (vertically) in a direction perpendicular to both the y-axis and the x-axis, as the spherical sensor 10 moves along the y-axis direction; such movement is represented by the z-axis.

A further analysis of the measured smoothness and/or trueness of the putting surface may be obtained by calculating residual acceleration (for each of the x-axis, y-axis, and z-axis), which is interpreted as irregularities in the putting surface that cause the spherical sensor 10 to be deflected from a perfect roll, e.g., without any bouncing or side-to-side movement. Residual acceleration may be first acquired by fitting a perfect sinusoidal wave, which corresponds to a perfect roll, to raw accelerometer information and determining the difference between the perfect sinusoidal wave and the raw accelerometer information. In an exemplary embodiment, various schemes may be used to compute an overall smoothness measurement, such as the root mean square (RMS) value of residual acceleration, mean absolute residual acceleration value or classification algorithms. Further, a Gaussian mixture model (GMM) may be used to classify the measured putting surface as one of a finite number of prototypical putting surfaces. For example, all putting surfaces may be classified into classifications of smoothness, e.g., perfectly smooth, unacceptably bumpy and/or marginally smooth. The measured putting surface may then be fitted into one or more of the aforementioned classifications using the GMM approach.

To enhance the characterization of the smoothness and/or trueness of the putting surface, the sensor 14, i.e., gyroscope, and/or a combination of the first accelerometer 13 and sensors 13*a* and/or 13*b* and the sensor 14 may be utilized to information regarding the orientation of the cylindrical sensor 10 as it moves from start to finish. The orientation information is then used to determine vertical and horizontal accelerations from three orthogonal accelerations (x-axis, y-axis, z-axis), which in general will not be aligned with the vertical and the horizontal plane. The smoothness can then be evaluated using the same approaches as described above for the vector combination of the three-axis measurements.

Figure 7:
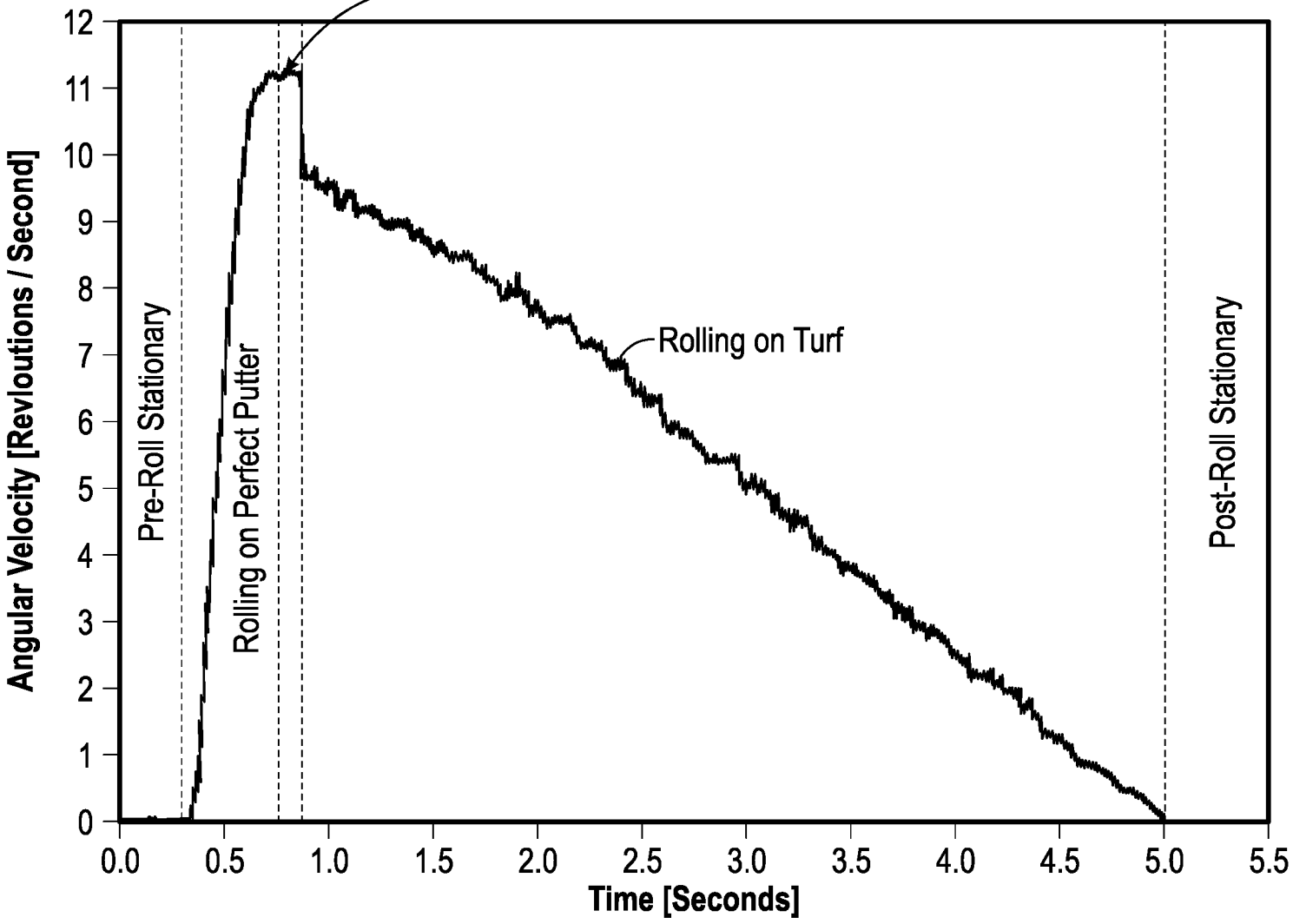
FIG. 7 shows a graph representing angular velocity vs. time of the spherical sensor as it moves across a putting surface from an initial resting position to a final resting position according to an embodiment of the present invention.

Green speed, which is the resistance of the putting surface to rolling, is another important property to consider when playing golf. The lower the resistance, the more sensitive the outcome of the putt is to errors by the golfer. A fast green (low rolling resistance) will roll a greater distance than a slow green (high rolling resistance). The green speed may be measured simultaneously with the same roll that is used to evaluate the smoothness and/or trueness of the putting surface. FIG. 7 illustrates a graph of the angular velocity of the spherical sensor 10 using motion data generated by the spherical sensor 10. More specifically, the graph maps the movement of the spherical sensor 10 as it moves from an initial rest position to a final rest position. In the first portion of the graph (between the first dotted line and the second dotted line), the spherical sensor 10 is accelerating down the inclined plane followed by a deceleration as the spherical 10 slows down on the putting surface before coming to a rest (between the third dotted line and the fourth dotted line).

Rolling distance can be computed by integrating the angular velocity and knowing the effective radius of the spherical sensor 10, thus yielding the same measure of green speed as is currently measured but without the need for a separate distance measurement using a tape measure or laser distometer, for example. The improved estimate of the effective radius of the spherical sensor 10 can be determined through the use of calibration rolls where rigid barriers stop the motion of the sphere at a known distance. Improvements can be made by calibrating rolls of fixed distances and determining the effective radius of the rolling of the spherical sensor 10. In addition, this effective radius may give a metric of the effective mow height or roll deformation. With sufficient accuracy of the gyroscope and accelerometer, it is possible to calculate and remove the effect of gravity in instances where the measurement area of interest is not flat. Another method of measuring the green speed in more localized areas of interest is to employ local rates of angular velocity decay. An additional method may also be to simply use the slope or rate of decay of the angular velocity determine an equivalent value and use shorter rolls or rolls affected by gravity.

As such, the measuring assembly 24 including the spherical sensor 10 provides an advantage in that the properties of firmness, smoothness, trueness and green speed can be measured by a user with a single portable apparatus, e.g., which can fit in the user's pocket, such that a team of operators along with a multitude of cumbersome equipment is not required to measure these properties.

In addition, it should be noted that the measuring assembly 24 including the spherical sensor 10 is not limited to measuring the putting surface of a golf course. In fact, the assembly 24 including the spherical sensor 10 can be utilized in any sport, such as, for example, cricket.

The aforementioned specific embodiments are illustrative, and many variations can be introduced on these embodiments without departing from the spirit of the disclosure or from the scope of the appended claims. In addition, elements and/or features of different examples, and illustrative embodiments may be combined with each other and/or substitute for each other within the scope of this disclosure.

What is claimed is:

1. A measurement apparatus for measuring physical properties of a playing surface of a golf course, the measurement apparatus comprising:

a spherical sensor comprising an accelerometer for measuring motion data relating to motion of the spherical sensor, a memory for storing the motion data, and a communication module for wirelessly transmitting the motion data to a computing device;

a substantially cylindrical body having a first and a second end, the first end configured to receive the spherical sensor; and a cap shaped to receive the spherical sensor and configured to removably attach to the first end of the cylindrical body, wherein the spherical sensor is secured between the cylindrical body and the cap, the cap being placed over the spherical sensor in attaching to the cylindrical body.

2. The measurement apparatus according to claim 1, wherein each of the cylindrical body and the cap has a hemi-spherical shape for receiving the spherical sensor.

3. The measurement apparatus according to claim 1, wherein the accelerometer measures acceleration of the spherical sensor.

4. The measurement apparatus according to claim 1, further comprising:

a gyroscope for determining an orientation of the spherical sensor.

5. The measurement apparatus according to claim 1, wherein the spherical sensor communicates the motion data to the computing device after the spherical sensor ceases movement.

6. The measurement apparatus according to claim 1, wherein the cap includes a mass greater than a mass of each of the spherical sensor and the cylindrical body.

7. The measurement apparatus according to claim 1, wherein the cap includes a female threaded surface and the cylindrical body includes a male threaded surface, such that the cap is removably attached to the cylindrical body by mating of the female threaded surface with the male threaded surface.

8. The measurement apparatus according to claim 1, wherein the measurement apparatus measures firmness of the playing surface.

9. The measurement apparatus according to claim 8, wherein the firmness of the putting surface is measured by dropping the spherical sensor disposed in the cylindrical body and the cap onto the putting surface from a predetermined height.

10. The measurement apparatus according to claim 9, wherein the spherical sensor disposed in the cylindrical body and the cap is dropped using a dropping device.

11. A method for measuring physical properties of a playing surface of a golf course, the method comprising:

measuring firmness of the playing surface with a spherical sensor disposed in a substantially cylindrical body and a cap, the spherical sensor comprising an accelerometer for measuring motion data relating to motion of the spherical sensor, a memory for storing the motion data, and a communication module for wirelessly transmitting the motion data to a computing device, wherein the spherical sensor is secured between the cylindrical body and the cap, the cap being placed over the spherical sensor in attaching to the cylindrical body; and measuring smoothness or trueness of the playing surface with the spherical sensor disassembled from the cylindrical body and the cap.

12. The method according to claim 11, wherein the step of measuring firmness of the playing surface further comprises:

dropping the spherical sensor disposed in the cylindrical body and the cap onto the playing surface.

13. The method according to claim 12, wherein the dropping step is performed using a dropping device.

14. The method according to claim 11, wherein the step of measuring smoothness or trueness of the playing surface further comprises:

disassembling the spherical sensor from the cylindrical body and the cap; and rolling the spherical sensor on the playing surface.

* * * * *